United States Patent [19]

Kobrin

[11] Patent Number: 4,898,380

[45] Date of Patent: Feb. 6, 1990

[54] EXERCISING DEVICE

[76] Inventor: Hy Herman Kobrin, 6840 N.W. 10th Dr., Margate, Fla. 33063

[21] Appl. No.: 253,555

[22] Filed: Oct. 5, 1988

[51] Int. Cl.[4] ..... A63B 21/00

[52] U.S. Cl. ..... 272/117; 272/143; D21/196

[58] Field of Search ..... 272/67, 68, 93, 116, 272/117, 119, 122, 123, 124, 125, 143; 24/230.5 AD, 230.5 W; 59/85, 90; 273/327, 343, 426, 427, 428; D21/4, 50, 191, 196, 197, 198, 203

[56] References Cited

U.S. PATENT DOCUMENTS

| | | | |
|---|---|---|---|
| 722,755 | 3/1903 | Roberts | 24/230.5 AD X |
| 802,026 | 10/1905 | Beall | 272/67 |
| 965,284 | 7/1910 | Dossetter | 272/122 X |
| 1,368,642 | 2/1921 | Midgley | 24/230.5 AD |
| 2,076,010 | 4/1937 | String | 273/427 |
| 2,217,052 | 10/1940 | Hall | 59/85 X |
| 3,197,899 | 4/1964 | Sutcliffe | 272/68 X |
| 3,672,675 | 6/1972 | Morris, Jr. | 273/327 |
| 4,353,203 | 10/1982 | Lotoski | 59/90 X |
| 4,491,327 | 1/1985 | Morris | 273/434 |
| 4,515,364 | 5/1985 | Rotella | 272/143 |
| 4,545,098 | 10/1985 | Schroer | 59/85 X |
| 4,684,123 | 8/1987 | Fabry | 272/119 |

FOREIGN PATENT DOCUMENTS

| | | | |
|---|---|---|---|
| 1237207 | 6/1986 | U.S.S.R. | 272/67 |

*Primary Examiner*—Richard J. Apley
*Assistant Examiner*—Robert W. Bahr
*Attorney, Agent, or Firm*—Alvin S. Blum

[57] ABSTRACT

Planar portable weights are formed of a heavy material in the shape of the letter "C" with a central portion having a reverse curve. The turned up ends each provide a hand-hold, and the central portion provides a third hand-hold so that the weight can be used for a variety of exercise maneuvers including two-handed isometrics. The weight is also adapted for engaging the lower legs for leg lifts. The weights have a planar configuration so that multiple weights may be held in one hand. The flat shape also facilitates packing and shipping.

14 Claims, 2 Drawing Sheets

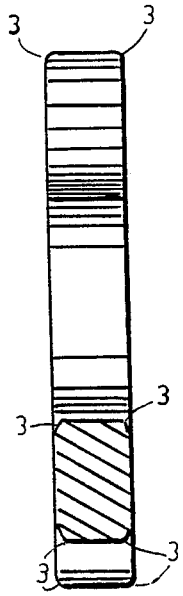
FIG. 3
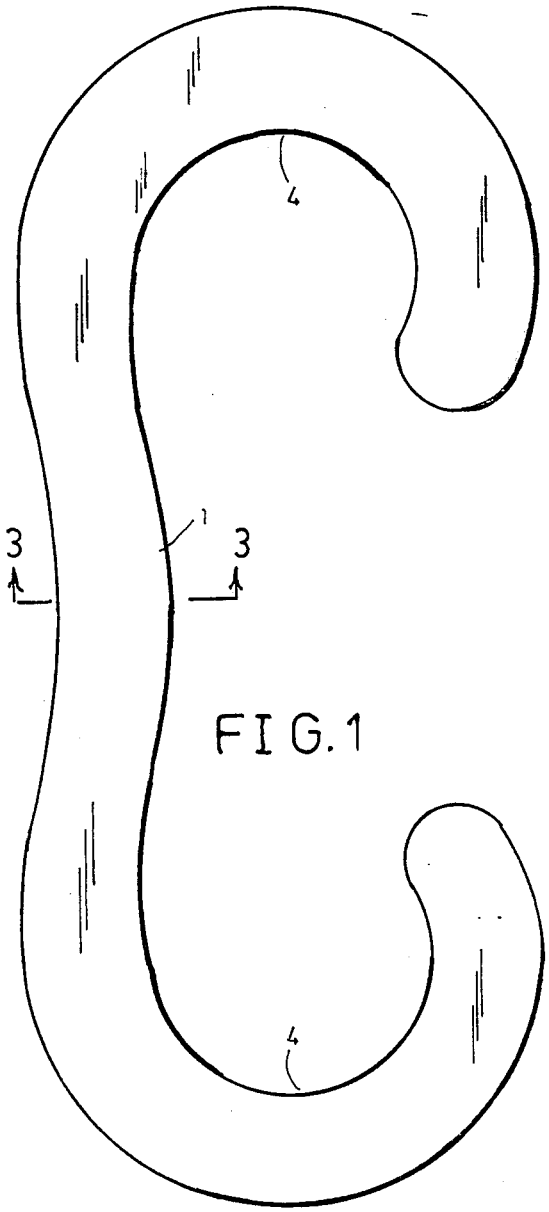
FIG. 1
FIG. 2
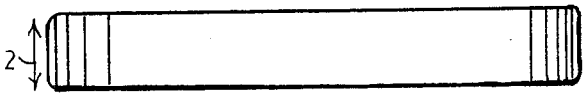

FIG. 5
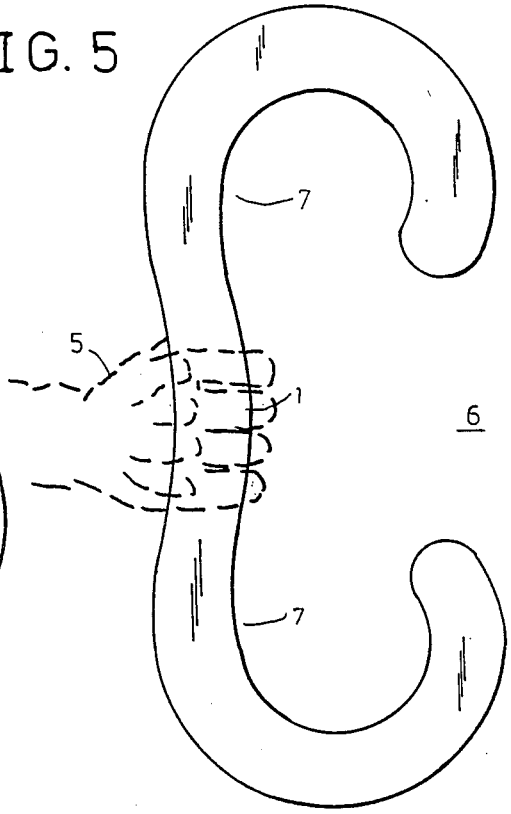
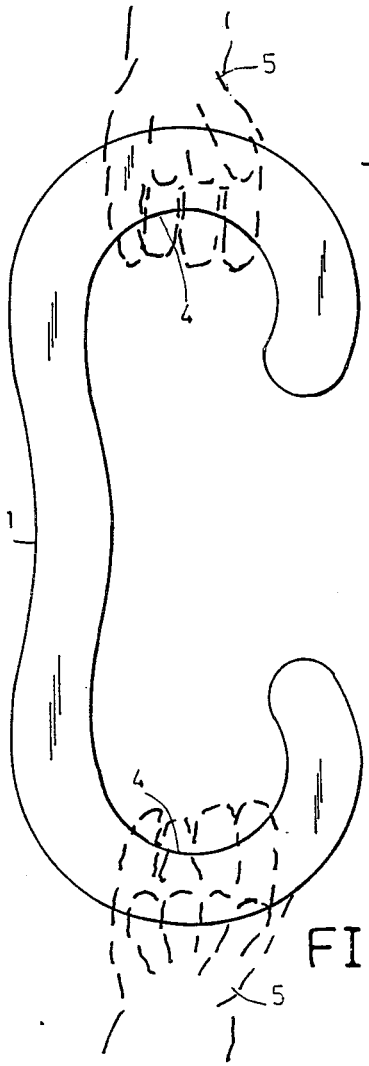
FIG. 4
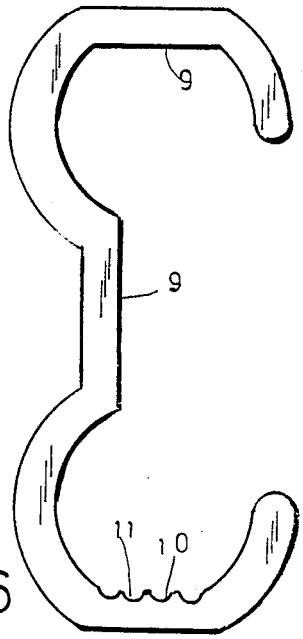
FIG. 6

EXERCISING DEVICE

BACKGROUND OF THE INVENTION

This invention relates to exercise devices and more particularly to small, compact weight devices of the type to be manipulated for exercising various parts of the body.

The classical exercise device for exercising the arms and upper body has been the dumb-bell which is a short horizontal grip/bar with weights at each end. The shape is awkward to package, store and ship and the number of different types of exercise maneuvers that can be performed with it are quite limited. One cannot double the weight by using two of them in one hand. The exercise device disclosed in U.S. Pat. No. 4,515,364 issued to Rotella discloses a more versatile hand-held resilient frame with snap-in weights in a complex structure.

SUMMARY OF THE INVENTION

It is accordingly an object of the invention to provide an exercise device of very simple construction, without any separate parts, that will be flat for economy of storage and shipping and that will provide the user with a great many more exercise maneuvers than the conventional dumb-bell. It is yet another object to provide the device as described that can be held with a second such device in one hand for doubling the weight.

It is yet another object to provide the device as described that provides a center grip and two end grips for different exercise maneuvers.

The exerciser of the invention comprises a planar, heavy, unitary structure having a generally "C" shaped configuration providing gripping areas at the two ends of the "C" shape. The "C" shape is modified by a reverse curved portion at the center to provide a central gripping area. All edges are gently rounded to avoid discomfort or injury in use. The device may be formed of a single piece of metal and may be optionally coated with a surface coating for protection, appearance or improved comfort.

These and other objects, advantages and features of the invention will become more fully apparent when the following detailed description of preferred embodiments of the invention is read in conjunction with the accompany drawings, in which:

BRIEF DESCRIPTION OF THE DRAWINGS

FIG. 1 is a plan view of the exercise device.

FIG. 2 is a end elevation view of the device.

FIG. 3 is a cross-sectional view taken on 3—3 of FIG. 1.

FIG. 4 is a plan view of the device held by hands at each end.

FIG. 5 is a plan view of the device by one hand at the center.

FIG. 6 is a plan view of an alternative embodiment of the device of the invention with flat gripping portions.

DETAILED DESCRIPTION OF PREFERRED EMBODIMENTS

Referring now first to FIGS. 1,2 and 3, a substantially flat, solid piece of metal such as stainless steel or bronze is formed in the general shape of the letter "C" with a reverse curve at its center portion 1. It has a thickness 2 of approximately five-eights of an inch and weighs in the range of 3 to 4 pounds. All of the edges 3 are smoothly rounded to prevent injury or discomfort. As shown in FIG. 4, the curved portions 4 at the ends of the "C" are adapted for gripping by either or both hands, with hands 5 shown in phantom. Certain isometric exercises can be most effectively performed with the two hands 5 grasping the ends 4 while the device is positioned across the chest or the neck with that body part fitting into reverse curve 1. When a single hand holds the device at end 4, the weight of the device puts extra force on the wrist for strengthening the muscles involved. As shown in FIG. 5, the hand 5 may grip the device at the center 1, either from the direction shown which exerts reduced torque forces on the wrist, or the hand may grip center portion 1 from within the "C" through passage 6 which puts even less torque on the wrist for exercises to strengthen only the upper arm and body. For leg exercises, the device may be positioned on the feet or ankles with the surfaces 7 resting on the feet or ankles for increasing the force required for leg lifts.

Because the devices are flat and not very thick, they may be held in pairs in one hand to double the lifting weight without the cumbersome weight adjusting mechanisms of such devices of the prior art. Furthermore, the shape is conducive to ease and economy of packing, shipping and storing. This is of great importance to those involved in regular weight training programs who must travel.

The devices may be stamped, molded or cast of a weighty and corrosion resistant material and may be coated with suitable coating materials for improved grip, appearance and corrosion-resistance by methods well known in the coating arts such as a resilient vinyl coating.

Alternatively, the device may be blow molded of hollow plastic and filled with weighty shot and the like.

The alternative embodiment illustrated in FIG. 6 shows the hand gripping portions 9 flattened for more comfortable grasping and the gripping portion 10 has indentations 11 for a more secure and comfortable grip.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. An exercise dvice comprising: a substantially planar weight of at least about three pounds having a shape generally corresponding to the shape of the letter "C", including two substantially identical turned in end portions and a central portion, between said end portions, having a reverse curvature;

each of said turned in end portions defining an unobstructed space with dimensions great enough to admit a hand and providing a hand-hold;

and said central portion defining an unobstructed space with dimensions great enough to admit a hand and providing yet another hand-hold for providing an exercise weight with a plurality of operating modes n a simple and economic structure, and in which the entire space enclosed between said turned in ends is free of other structures.

2. The device according to claim 1 is a unitary construction.

3. The device according to claim 2 formed of a metallic composition.

4. The device according to claim 3 covered with a protective coating.

5. The device according to claim 3, in which said metallic composition includes stainless steel.

6. The device according to claim 3, in which said metallic composition includes bronze.

7. The device according to claim 1, in which the edges are smoothly rounded for comfort and safety.

8. The device according to claim 1, in which said hand-holds are shaped to provide comfortable gripping surfaces.

9. The device according to claim 8, in which said comfortable gripping surfaces include finger indentations.

10. The device according to claim 1 formed in a hollow shape of a first composition and filled with weighty material of a second composition.

11. The device according to claim 10, in which said hollow shape is a blow-molded construction.

12. The device according to claim 1, in which said turned in ends define unobstructed spaces having dimensions great enough for admission of the lower legs of the user for leg lifting exercise maneuvers.

13. The device according to claim 1, in which each of said turned in ends includes a straight portion having a length greater than the width of palm of the hand.

14. The device according to claim 13, in which said central portion includes a straight portion having a length greater than the width of the palm of the hand.

* * * * *